United States Patent [19]

Meisel, Jr.

[11] 4,131,201

[45] Dec. 26, 1978

[54] CONTINUOUS BELT AGGREGATE SEPARATOR

[75] Inventor: Thomas C. Meisel, Jr., Peoria, Ill.

[73] Assignee: Caterpillar Tractor Co., Peoria, Ill.

[21] Appl. No.: 827,206

[22] Filed: Aug. 24, 1977

[51] Int. Cl.[2] ..... B07C 5/12

[52] U.S. Cl. ..... 209/661

[58] Field of Search ..... 209/100, 102

[56] References Cited

U.S. PATENT DOCUMENTS

| | | | |
|---|---|---|---|
| 3,547,263 | 12/1970 | Green | 209/102 |
| 3,653,509 | 4/1972 | Goodman, Jr. | 209/102 |
| 3,713,537 | 1/1973 | Walker | 209/102 |

*Primary Examiner*—Allen N. Knowles

*Attorney, Agent, or Firm*—Wegner, Stellman, McCord, Wiles & Wood

[57] ABSTRACT

A separator for aggregate including an upwardly opening bin having converging sides at its lowermost extremity, an endless, cleated belt adjacent the lower extremity and defining, together with at least one of the sides, a first discharge opening, a motor for driving the belt longitudinally of the first discharge opening and a second discharge opening at an end of the bin adjacent the belt. The bin receives aggregate of mixed size and the smaller rocks pass through the first discharge opening while the larger rocks pass through the second discharge opening. Movement of the belt agitates material received in the bin and conveys the larger rocks to the second discharge opening.

5 Claims, 6 Drawing Figures

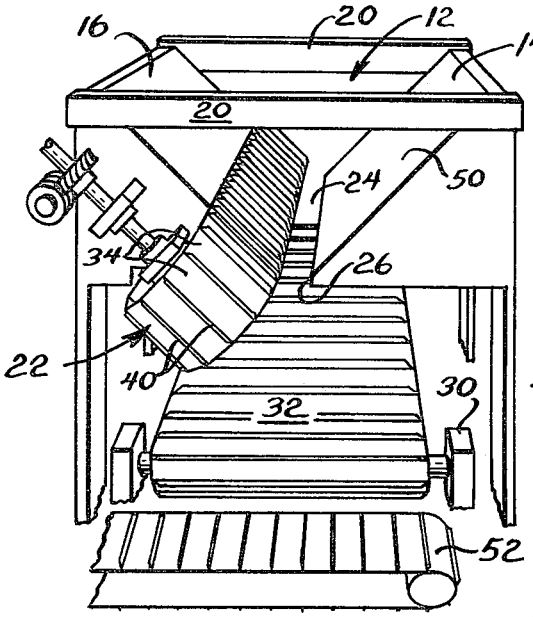
Fig. 1
Fig. 2
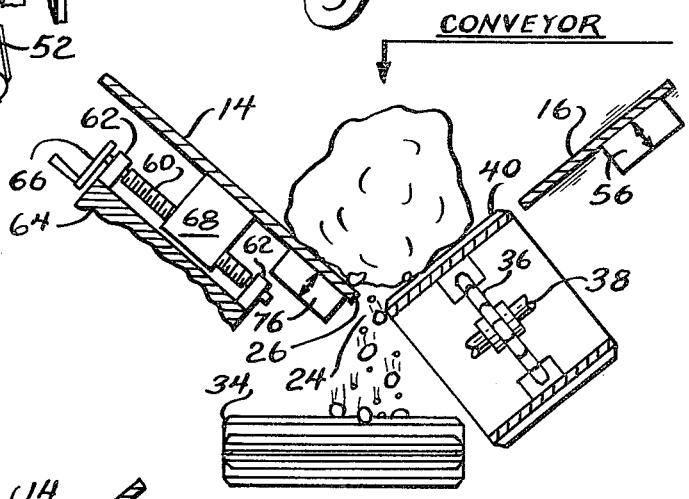
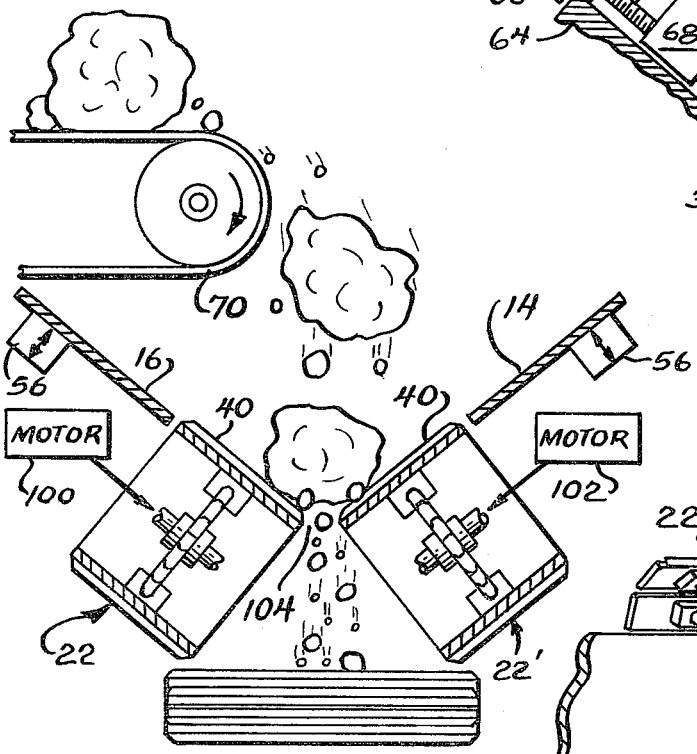
Fig. 3
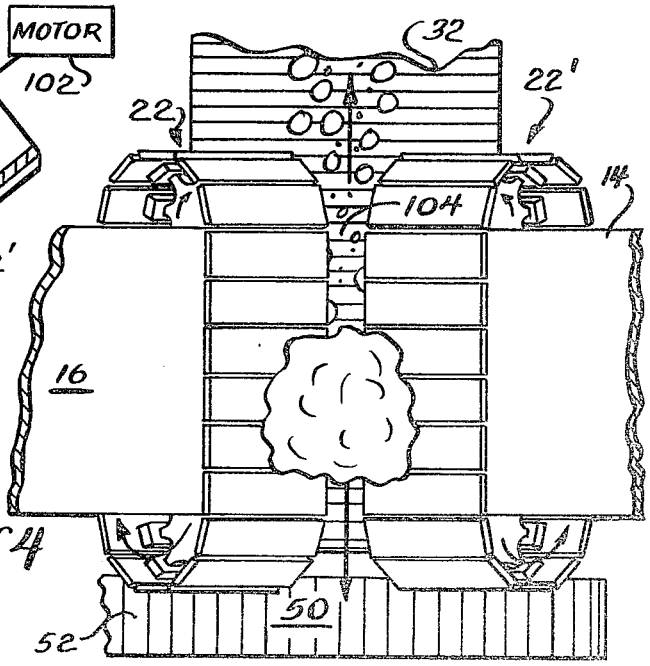
Fig. 4

CONTINUOUS BELT AGGREGATE SEPARATOR

BACKGROUND OF THE INVENTION

This invention relates to separators and, more specifically, to separators particularly useful for separating aggregate of various sizes into differing fractions.

Conveyor haulage of aggregate from earth moving sites is desirable on long hauls due to the economy of operation. Conveyors, however, will not handle large materials, such as large rocks or boulders. When large rocks or boulders are present, it is necessary to grind or crush the aggregate to eliminate the large rocks or boulders before the aggregate may be loaded onto a conveyor. Alternately, an excavating machine of the type which grinds or crushes the material during the excavating process as, for example, a bucket wheel excavator, must be utilized in the excavating process if the grinding or crushing is to be avoided.

Still another alternative is the separation of the overly large material from the sizes which can be easily conveyed. The large rocks or boulders are then either crushed, discarded or hauled separately. Present day separators utilized in practicing the last mentioned alternative utilize vibrating screens. The same are rather expensive due to strength requirements and are quite prone to clogging.

SUMMARY OF THE INVENTION

The present invention is directed to overcoming one or more of the above problems.

According to the present invention, there is provided a bin for receiving material to be separated and which terminates in a lower, first discharge opening. The first discharge opening is defined in part by a uni-directionally movable element. Means are provided for moving the movable element and a second discharge opening is located in the bin at one end thereof adjacent the movable element. Material loaded in the bin will have smaller particles pass through the first discharge opening while the larger particles will be directed by the movable element to the second discharge opening. At the same time, the movable element will serve to agitate the material within the bin to facilitate separation.

Other objects and advantages will become apparent from the following specification taken in connection with the accompanying drawings.

DESCRIPTION OF THE DRAWINGS

FIG. 1 is a perspective view of one form of a separator made according to the invention;

FIG. 2 is a somewhat schematic, end view of the form of separator illustrated in FIG. 1 with parts broken away for clarity;

FIG. 3 is a view similar to FIG. 2, but of a modified embodiment of the invention;

FIG. 4 is a plan view of the embodiment of FIG. 3;

DESCRIPTION OF THE PREFERRED EMBODIMENTS

Figure 5:
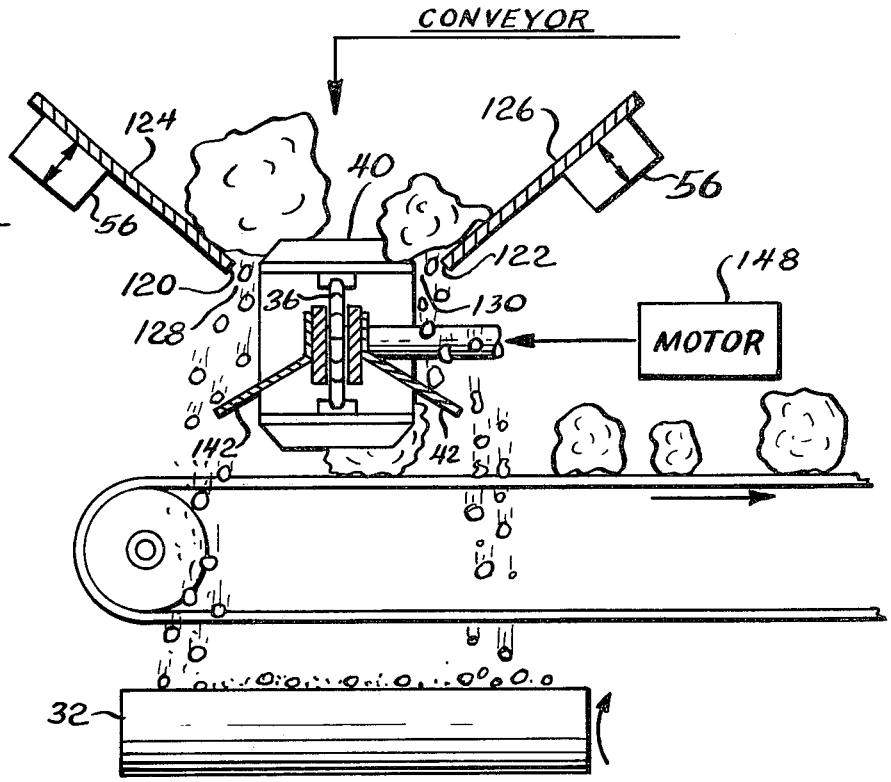
FIG. 5 is a view similar to FIG. 2, but of still another modified embodiment of the invention.

Three embodiments of a separator made according to the invention are illustrated in the drawings and, with reference to FIGS. 1 and 2, the first is seen to include a base, generally designated 10, supporting an upwardly open bin, generally designated 12. The bin 12 comprises a pair of generally planar, plate-like metal side walls 14 and 16 which converge from top to bottom and which are held in assembled relation by the base 10 and cross members 20 at opposite ends.

The side wall 16 is in part defined by a movable section, generally designated 22, which is unidirectionally movable longitudinally of an opening 24 defined by the lower edge 26 of the side wall 14. The opening 24 serves as a first discharge opening from the separator and suitable framework 30 supports an endless, first take-away conveyor 32 by which material passing through the opening 24 may be conveyed to a point of use. In this respect, it is to be noted that the side walls 14 and 16, as well as the movable section 22, are functionally imperforate so that separation is principally obtained by reason of the fact that smaller particles will pass through the opening 24 while larger ones will be retained on the side walls 14 and 16 and on the movable section 22.

The movable section 22 is preferably defined by an endless belt and, where great strength is required, a conventional track, such as used on crawler-type vehicles, may be employed. Thus, the belt is formed by a plurality of conventionally interconnected links 34 trained about spaced sprockets 36 (only one of which is shown), at least one of which is driven by a drive shaft 38. Each of the links 34 includes outwardly extending cleats 40 which serve to engage material loaded into the bin 12. As mentioned, the smaller material will pass through the opening 24, as best seen in FIG. 2, to the underlying take-away conveyor 32, while the larger material will be conveyed by the cleats 40 in the same direction that the upper run of the belt is moving. If, with reference to FIG. 1, the belt is being driven so as to move forwardly, then the space underlying the forwardmost cross member 20 and bounded by the sides 14 and 16 at the end of the frame 10 and designated 50, serves as a second discharge opening for the larger material retained on the sides 14 and 16 and on the belt. The larger material emanating from the second discharge opening is dumped onto a second take-away conveyor 52 which may be of any desired construction and which is adjacent the end of the belt comprising the movable section 22. From there the larger material may be conveyed to a point whereat it is discarded or crushed or otherwise broken prior to being returned to the bin 12.

It will be appreciated that certain of the smaller material, in various orientations, may not pass through the opening 24. Movement of the movable section 22, while conveying the large fraction to the second discharge opening 50, will agitate such material to cause it to change its orientation so that, in many instances, it will find a new orientation whereat it will pass through the opening 24.

Where material which tends to agglomerate is to be separated, it is frequently desirable that either or both of the sides 14 and 16 be oscillated and to this end, conventional vibrating apparatus 56 may be secured to one or the other of the sides 14 and 16, or both, to assist in breaking up the material during the separating operation.

In order to add flexibility to the separation capabilities of the apparatus, it is preferred that means be provided whereby the size of the opening 24 may be varied. As seen in FIG. 2, a screw shaft 60 is journalled in bearings 62 affixed to stationary structure 64 which may form part of the frame 10. A crank 66 is secured to one end of the screw shaft 60, while a traveling nut structure 68 is mounted on the screw shaft 60 intermediate its ends. The traveling nut structure 68, in turn, mounts the side wall 14. Suitable guides (not shown) may also be employed.

The screw shaft 60 is oriented to be transverse to the length of the opening 24 and, as a consequence, by selective use of the crank 66, the width of the opening 24 may be selectively varied.

The bin 12 may be loaded by any suitable means. Typically, a conveyor, shown schematically at 70, will be utilized for the purpose, although in some cases, batch loaders, such as vehicles, as a front end loader, may be employed.

A modified embodiment of the invention is illustrated in FIGS. 3 and 4 and, in the interests of brevity, only the manner in which it differs from the embodiment shown in FIGS. 1 and 2 will be described. Where identical components are utilized, identical reference numerals will be utilized. Where similar, but nonidentical components are utilized, like, but primed reference numerals will be utilized.

In the embodiment illustrated in FIGS. 3 and 4, each of the sides 14' and 16 is provided with the movable section 22' and 22, respectively. That is, the side wall 14' corresponding to the side wall 14 in the first embodiment is provided with a movable section 22' which may, in all respects, be identical to the movable section previously described. However, the belts defining the movable sections 22 and 22' are independently driven by separate motors 100 and 102 and the opening 104 at the bottom of the bin corresponding to the opening 24 is defined by the lower edges of the upper runs of the belts defining the movable sections 22 and 22'.

The motors 100 and 102 drive the upper runs of the associated belts in opposite directions and at different speeds. Preferably, the belt forming the movable section having its upper run moving in the direction of the second discharge opening 50 is driven at a linear rate greater than the other belt.

As a consequence of this construction, the larger material will continue to be conveyed to the second discharge opening but there will be increased agitation of the material within the bin by reason of the oppositely directed movement of the belts. Consequently, with the greater agitation, more efficient separation will occur.

Figure 6:
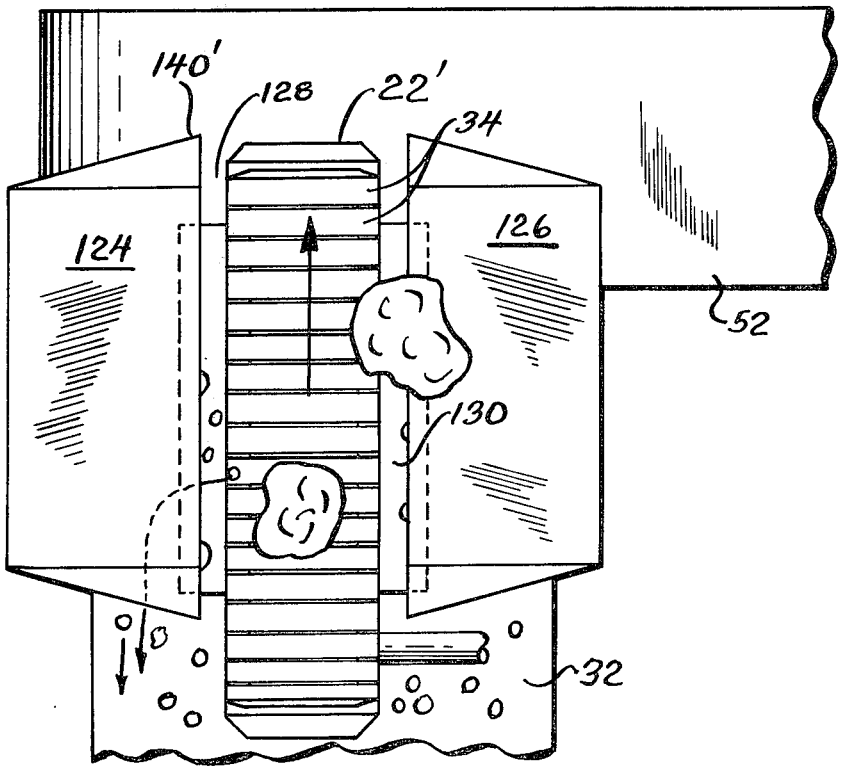
FIG. 6 is a plan view of the embodiment shown in FIG. 5.

Whereas the embodiments illustrated in FIGS. 1–4, inclusive, utilize a conveyor as the movable section and which has its upper run or runs substantially coplanar with the corresponding one of the side walls 14, 16 or 14', the embodiment illustrated in FIGS. 5 and 6 utilize a movable section 22" which is disposed between, but spaced from, the lower edges 120 and 122 of two converging side walls 124 and 126. The conveyor 22" is comprised of a series of links 34, each having the cleats 40, and the side walls 124 and 126 are provided with the vibrators 56.

The embodiment illustrated in FIGS. 5 and 6 has a pair of classifying openings 128 and 130, with the opening 128 being defined by the edge 120 and the corresponding side of the movable section 22" and the opening 130 being defined by the edge 122 and the adjacent edge of the movable section 22". A conveyor 32 underlies the two openings 128 and 130 and, at one end of the side walls 124 and 126, there is an opening 140 and underlying an end of the movable section 22" at the opening 140 is the second take-away conveyor 52.

The conveyor defining the movable section 22" is driven by a motor 141 and downwardly angled, diverging deflectors 142 are mounted on the frame which carries the conveyor 22 and serve to deflect the smaller particles passing through the openings 128 and 130 away from the upper surface of the lower run of the conveyor.

The invention further contemplates that there be an end wall for the bins of all embodiments on the end thereof remote from the discharge openings 50 and 140, the showing of such a wall being omitted for clarity. Where one or both side walls are movably mounted, as in FIGS. 1 and 2, the end wall may be formed of two overlapping, slidably engaged plates, each secured to a respective side wall so as to be movable therewith.

From the foregoing, it will be appreciated that a separator made according to the invention is extremely rugged and capable of supporting, without clogging, large aggregate. It will be appreciated that through means such as those illustrated in FIG. 2, the openings of any of the embodiments may be varied to suit various classification purposes for various materials and various sizings. It will also be appreciated that, as desired, the speed of the movable sections can be controlled through variable speed motors to suit sizing purposes and material variation.

It will further be appreciated that residence times can be controlled by speed variation and, in the case of the embodiment illustrated in FIGS. 3 and 4, without any sacrifice in the degree of agitation applied to the materials to be separated.

The embodiments of the invention in which an exclusive property or privilege is claimed are defined as follows:

1. A separator comprising an upwardly opening bin having converging functionally imperforate sides at its lowermost extremity, the lowermost edges of said sides being spaced to define a first discharge opening, at least one of said sides, adjacent said first opening, including a section unidirectionally movable longitudinally of said first opening, means for unidirectionally moving said section, and a second discharge opening at an end of said bin adjacent said section, said section comprising an endless, jointed cleated crawler type track.

2. A separator comprising an upwardly opening bin having converging functionally imperforate sides at its lowermost extremity, the lowermost edges of said sides being spaced to define a first discharge opening, at least one of said sides, adjacent said first opening, including a section unidirectionally movable longitudinally of said first opening, means for unidirectionally moving said section, and a second discharge opening at an end of said bin adjacent said section, and means for oscillating at least one of said sides.

3. A separator comprising an upwardly opening bin having converging functionally imperforate sides at its lowermost extremity, the lowermost edges of said sides being spaced to define a first discharge opening, at least one of said sides, adjacent said first opening, including a section unidirectioanlly movable longitudinally of said first opening, means for unidirectionally moving said section, and a second discharge opening at an end of said bin adjacent said section, the other of said sides, adjacent said first opening including a section unidirectionally movable longitudinally of said first opening, and means for moving said other side section unidirectionally and oppositely of said one side section and at a differing rate of travel.

4. A separator comprising a bin for receiving material to be separated and terminating in a lower first discharge opening, said first opening being defined in part by a unidirectionally movable, functionally imperforate element, means for moving said movable element, and a second discharge opening in said bin at one end thereof adjacent said movable element, said bin being defind by a pair of converging side walls spaced from each other at their lower edges, and said movable element comprising a belt located between, but spaced from, said edges.

5. A separator comprising a bin for receiving material to be separated and terminating in a lower first discharge opening, said first opening being defined in part by a unidirectionally movable, functionally imperforate element, means for moving said movable element, and a second discharge opening in said bin at one end thereof adjacent said movable element, said bin being defined by a pair of converging side walls, and said movable element comprising an endless belt having its upper run disposed substantially coplanar with one of said side walls.

* * * * *